US005892164A

United States Patent [19]

Garg et al.

[11] Patent Number: 5,892,164

[45] Date of Patent: Apr. 6, 1999

[54] CARBON STEEL POWDERS AND METHOD OF MANUFACTURING POWDER METAL COMPONENTS THEREFROM

[75] Inventors: Diwakar Garg, Emmaus; Kerry Renard Berger, Lehighton; James Garfield Marsden, Lenhartsville, all of Pa.

[73] Assignee: Air Products and Chemicals, Inc., Allentown, Pa.

[21] Appl. No.: 62,534

[22] Filed: Apr. 17, 1998

Related U.S. Application Data

[63] Continuation-in-part of Ser. No. 820,737, Mar. 19, 1997, Pat. No. 5,777,247.

[51] Int. Cl.[6] ..... C22C 33/02; B22F 3/12

[52] U.S. Cl. ..... 75/246; 75/231; 75/243; 75/252; 419/11; 419/38; 419/57; 419/58

[58] Field of Search ..... 75/246, 231, 243, 75/252; 419/11, 38, 57, 58

[56] References Cited

U.S. PATENT DOCUMENTS

| | | | |
|---|---|---|---|
| 4,724,000 | 2/1988 | Larson et al. | 75/236 |
| 5,507,853 | 4/1996 | Ogura et al. | 75/252 |
| 5,525,293 | 6/1996 | Kagawa et al. | 419/65 |
| 5,766,304 | 6/1998 | Uenosono et al. | 75/252 |

OTHER PUBLICATIONS

Product Bulletin 169D from Hoeganaes Corporation entitled "Ancorsteel 1000—Atomized Steel" (Mar. 1980).

Marsden, James G. "Microstructures of Sintered Iron and Iron Alloys" from Air Products pp. 1–14 (date unknown).

S. J. Jamil et al. "Investigation and analysis of liquid phase sintering of Fe–Cu and Fe–Cu–C compacts" from Powder Metallurgy International, vol. 17, No. 6, pp. 65–71 (1985).

J. M. Torralba et al "Influence of the Nature of Powders on Properties and Microstructure of Sintered Cu and Ni Steels" from Powder Metallurgy International, vol. 24, No. 4, pp. 226–228 (1992).

Cambronero et al. "Microstructure and Properties of P/M Cu–P–Steels" from PMI, vol. 22, No. 2, pp. 26–28, (1990).

Dautzenberg et al. "Dimensional Behaviour of Copper–Carbon Sintered Steels" (1985).

Lawcock et al. "Effect of carbon on dimensional and microstructural characteristics of Fe–Cu compacts during sintering" from Powder Metallurgy, vol. 33, No. 2, pp. 147–150 (1990).

C. Duradaller, "The Effects of Additions of Copper, Nickel and Graphite on the Sintered Properties of Iron–Base Sintered P/M Parts" from Progress In Powder Metallurgy, vol. 25, pp. 73–100, (1969).

Y. Trudel et al. "Comparative Study of Fe–Cu–C Alloys Made From Mixed and Prealloyed Powders" from Modern Developments In Powder Metallurgy, vol. 6, pp. 305–322 (1973).

Y. Trudel et al. "Properties of Iron Copper Alloys Made from Elemental or Prealloyed Powders" from The International Journal of Powder Metallurgy and Powder Technology, vol. 11, No. 1, pp. 5–16, (1975).

*Primary Examiner*—Ngoclan Mai
*Attorney, Agent, or Firm*—John M. Fernbacher

[57] ABSTRACT

Fine powders of iron with less than 5% by weight graphite, copper, and an organic binder can be formed into shapes having a green density of up to about 7.4 g/cc and sintered in a hydrogen containing atmosphere to yield parts having minimum variations in physical properties. Incorporation of small quantities of copper, e.g. 1% or less by weight, negates variations in physical properties of sintered parts that were subjected to variations in the hydrogen content of the sintering atmosphere.

22 Claims, No Drawings

CARBON STEEL POWDERS AND METHOD OF MANUFACTURING POWDER METAL COMPONENTS THEREFROM

CROSS-REFERENCE TO RELATED APPLICATIONS

This application is a continuation-in-part of U.S. Ser. No. 08/820,737 filed Mar. 19, 1997, U.S. Pat. No. 5,777,247.

STATEMENT REGARDING FEDERALLY SPONSORED RESEARCH OR DEVELOPMENT

Not applicable.

BACKGROUND OF THE INVENTION

The present invention pertains to powder metallurgy and the preparation of ferrous metal powders and the use of such powders to produce near net shape components.

Powder metallurgy is becoming increasingly important these days for producing a variety of simple- and complex-geometry near net shape carbon steel components for the automobile and appliances industries. These components require close dimensional tolerances, good strength and surface properties such as hardness and wear resistance. Manufacture of the components involves pressing metal powders that have been premixed with graphite and organic lubricants into useful shapes, generally is referred to as as-pressed or green components, and then sintering the shaped components at high temperatures in a batch or continuous furnace in the presence of a controlled atmosphere. The sintered components can then be used as is or given minor surface finishing.

Carbon steel powder metal components are generally produced from metal powders containing a mixture of iron and graphite, which is added to the powder to provide strength, increase surface hardness, and control the dimensions of sintered components. The components pressed from these powders can be sintered in a continuous furnace operated above about 2,000° F. (1093° C.) in the presence of a controlled atmosphere containing primarily a mixture of nitrogen and hydrogen. The amount of hydrogen present in the atmospheres varies between 2 to 15% depending upon the source and supply mode of the atmospheres.

The controlled atmospheres used for sintering carbon steel components are generally endothermic (produced by endothermic generators), pure nitrogen blended with endothermic generated atmosphere, dissociated ammonia or pure hydrogen. The endothermic atmospheres are produced by catalytically combusting a controlled amount of hydrocarbon gas, such as natural gas in air in endothermic generators. The endothermic atmospheres typically contain nitrogen (~40%), hydrogen (~40%), carbon monoxide (~20%), and impurities in the form of carbon dioxide, moisture and unreacted hydrocarbon gas. The atmospheres produced by dissociating ammonia contain hydrogen (~75%), nitrogen (~25%) and impurities in the form of moisture and unconverted ammonia.

The use of endothermically generated atmospheres for sintering carbon steel components have been known to cause undesirable cyclic carburization and decarburization of sintered components due to the presence of high levels of carbon monoxide, hydrogen and moisture. Therefore, endothermically generated atmospheres by themselves are rarely used to produce carbon steel components requiring close dimensional tolerances, good strength and consistent surface properties such as hardness and wear resistance. These atmospheres are, therefore, mixed with pure nitrogen to reduce (1) effective concentrations of carbon monoxide, hydrogen and moisture and (2) undesirable cyclic carburization and decarburization. For example, 20% of endothermically generated atmosphere is mixed with 80% nitrogen to provide an effective hydrogen concentration of about 8%, the resulting atmosphere used to produce carbon steel components with consistent quality and properties.

The use of dissociated ammonia atmospheres by themselves for sintering carbon steel components have been known to severely decarburize sintered components due to the presence of high levels of hydrogen. Therefore, these atmospheres alone are not used for sintering carbon steel components. They are mixed with pure nitrogen to reduce the effective concentration of hydrogen to about 12% prior to being used for sintering carbon steel components.

The presence of 8 to 12% hydrogen in blends of nitrogen and endothermic atmospheres and nitrogen and dissociated ammonia atmospheres often decarburizes surfaces of sintered components, thereby reducing their surface hardness and wear resistance. The extent of reduction in surface hardness or wear resistance varies with the amount of hydrogen present in these atmospheres. Because of these variations, it is difficult to pick the right source and supply mode of these atmospheres for sintering carbon steel components and produce sintered components with consistent quality and properties.

A small amount of an enriching gas such as natural gas, or any other hydrocarbon gas, can be added to these atmospheres to counter the decarburization effect of hydrogen. However, the selection of an improper amount of an enriching gas results in forming soot in the furnace and carburizing furnace components such as the muffle and belt, thus reducing their useful life. Therefore, there is a need to (1) reduce variations in the physical properties of sintered carbon steel components due to variation in the amount of hydrogen in the atmosphere and (2) produce carbon steel components with consistent quality and properties.

A number of workers in the field have proposed adding copper to iron-graphite powders to increase the properties of the pressed and sintered parts. For example R. L. Lawcock and T. J. Davies in a technical paper titled "Effect of Carbon on Dimensional and Microstructural Characteristics of Fe—Cu Compacts During Sintering" describe sintering of Fe—Cu—C compacts containing 1% or more of copper in 75% hydrogen and 25% nitrogen atmosphere. A technical paper by N. Dautzenberg and H. J. Dorweiler titled "Dimensional Behavior of Copper-Carbon Sintered Steels" describes sintering of Fe—Cu—C compacts containing 1% or more copper. J. M. Torralba, L. E. G. Cambronero and J. M. Ruiz in their paper titled "Influence of the Nature of Powders on Properties and Microstructure of Sintered Cu and Ni Steels" describe sintering of Fe—Cu—C compacts containing 2% or more of copper. C. Durdaller, describes sintering of Fe—Cu—C compacts containing 2% or more of copper in his publication titled "The Effect of Additions of Copper, Nickel and Graphite on the Sintered Properties of Iron-Base Sintered P/M Parts." Y. Trudel and R. Angers published a paper titled "Comparative Study of Fe—Cu—C Alloys Made From Mixed and Prealloyed Powders" in which they describe sintering of Fe—Cu—C compacts containing 2% or more of copper. Another paper by Y. Trudel and R. Angers titled "Properties of Iron Copper Alloys Made from Elemental or Prealloyed Powders" describe sintering of Fe—Cu—C compacts containing 1% or more of copper. In a technical paper by S. J. Jamil and G. A. Chadwick titled "Investigation and Analysis of Liquid Phase Sintering of Fe—Cu and Fe—Cu—C Compacts" the authors describe sintering of Fe—Cu and Fe—Cu—C compacts containing 10% copper.

None of the prior art workers disclosed Fe—Cu—C powders or parts made therefrom where the copper context was less than 1% by weight and the effects of atmosphere compositions on the as sintered part, especially on surface properties of the finished parts.

BRIEF SUMMARY OF THE INVENTION

It has been discovered that in order to reduce variations in the properties of sintered carbon steel powder metal parts small amounts of fine copper powder should be incorporated into a mixture of powdered graphite and powdered iron (steel). The powder mixture can be mixed with a lubricant and pressed into a shape having a green density of between 6.4 and 7.4 g/cc followed by sintering under an atmosphere consisting of from 1 to 15% by volume hydrogen, up to about 0.5% by volume enriching gas, balance nitrogen. Pressed and sintered carbon steel components produced in accord with the present invention show reduced variations in the physical properties due to varying amount of hydrogen in the sintering furnace atmosphere, with consistent quality, and without significantly increasing the cost of metal powders. The mixing of a small amount of fine copper powder to the iron-graphite powders has unexpectedly been found to reduce and/or eliminate surface decarburization of sintered components due to variations in the amount of hydrogen in the atmosphere. The amount of fine copper powder mixed with the metal powder and graphite is selected in such a way that the physical properties of sintered carbon steel components are not materially different from similar components produced without using copper powder and that the cost of the powders is not significantly increased.

DETAILED DESCRIPTION OF THE INVENTION

Manufacture of carbon steel components by powder metallurgical techniques has been known for a long time. One-way to achieve the proper composition of the final product is to mix powdered graphite with a powdered or atomized steel composition such as the one sold under the trade name ANCORSTEEL 1000 by Hoeganaes Corporation of Riverton, N.J. In order to enhance the mechanical properties, e.g. surface hardness and transverse rupture strength, it has been known to add from 2 to 10 percent copper powder to the powdered graphite and the atomized steel composition which mixture is then pressed and sintered into a final shape.

According to the present invention incorporating a small amount, e.g. less than 1 percent, of fine copper powder into a mixture of graphite powder and atomized steel, wherein the particle size of all constituents is controlled, permits pressing and sintering of components that will exhibit physical properties that are not significantly different from prior art carbon steel components.

The basic material for the present invention is a powder having a significantly high iron content and low carbon content so that the product resulting from the blending of the graphite, iron based powder and copper is considered to be a steel product. Any atomized ferrous metal that would be generally classified as steel can be used as the starting material with the graphite component being adjusted to produce a component with the required carbon analysis.

The iron-graphite powders used for producing carbon steel components according to the present invention can contain carbon in the form of graphite, by weight, from 0.2 to 1.2%, preferably from 0.5 to 1.2%, more preferably from 0.8 to 1.2%.

The amount of fine copper powder mixed with the iron-graphite powders can vary, by weight from 0.1 to 0.9%, preferably from 0.1 to 0.75%, more preferably from 0.2 to 0.6%.

It is important to carefully select the particle size of iron and copper powders for producing carbon steel components according to the present invention. It is preferable that at least 75% by weight of the particles present in the iron powder are retained by a 325 U.S. mesh sieve. More preferably, at least 85% by weight of the particles present in the iron powder are retained by the 325 U.S. mesh sieve. In addition, it is preferable that at least 10% by weight of the particles present in the iron powder are retained by a 100 U.S. mesh sieve. Likewise, it is preferable that at least 60% by weight of the particles present in the fine copper powder pass through the 325 U.S. mesh sieve. More preferably, at least 70% by weight of the particles present in the fine copper powder pass through the 325 U.S. mesh sieve. In addition, it is preferable that all the particles present in the fine copper powder pass through a 150 U.S. mesh sieve.

The iron-graphite-copper powders are mixed well prior to being introduced into a die for pressing components. The powders are mixed with an organic lubricant selected from the group consisting of zinc stearate, lithium stearate and N,N'-Ethylenebisstearamide (sold under the tradename Acrawax by Glyco Inc. Norwalk Conn.) to assist in pressing components. The amount of a lubricant used can vary from 0.2 to 2.0%, preferably from 0.4 to 1.5%, more preferably from 0.5 to 1.0% by weight. While it is conventional to use a lubricant mixed with the powder metal components there are processes being developed that use a die wall lubrication technique.

The carbon steel components can be pressed to a green density varying from 6.4 to 7.4 g/cc. Preferably, they can be pressed to a green density selected from 6.6 to 7.2 g/cc. More preferably, they can be pressed to a green density selected from 6.8 to 7.2 g/cc.

Carbon steel components pressed from the iron-graphite-copper powders are sintered in a continuous furnace, according to the present invention, at a temperature above about 2,000° F. (1093° C.) under a nitrogen-hydrogen atmosphere. The nitrogen-hydrogen atmospheres used for sintering components, according to the present invention, can be produced by well known techniques, e.g. by blending nitrogen with hydrogen, endothermic generators or dissociation of ammonia. The hydrogen concentration in these atmospheres can vary from 1 to 15%, preferably from 1 to 12% by volume. A very low concentration of an enriching gas such as methane, natural gas, petroleum gas, or propane can optionally be added to the nitrogen-hydrogen atmospheres. The concentration of enriching gas can vary from 0 to 0.5% by volume.

The carbon steel components made from iron-graphite-copper powders are heated slowly in the pre-heating zone and then sintered at high temperature (above about 2,000° F., 1093° C.) in a continuous furnace. It is believed that the fine copper powder melts and forms a protective layer around the iron-graphite particles prior to reaching the sintering temperature. The formation of this protective layer is believed to be responsible for reducing surface decarburization of carbon steel components even in the presence of increased amounts of hydrogen in the atmosphere. It is also believed that the decarburization protection provided by the fine copper powder increases with the amount of fine copper powder used in the iron-graphite-copper powder. However, increasing the amount of copper in the powder not only increases the overall cost of the powder, but also significantly changes the physical and mechanical properties of the carbon steel components. Therefore, it is important to select the amount of copper mixed with the iron-graphite powder in such a way that the original properties of sintered carbon steel components without copper being added are not greatly changed and that the cost of metal powders is not significantly increased.

In order to demonstrate the present invention a number of experiments were carried out to produce and evaluate transverse rupture strength test bars. The test bars were formed from iron-graphite powder and iron-graphite powder mixed with 0.1, 0.2, 0.3, 0.5 and 1.0% fine copper powder and sintered at 2,050° F. (1121° C.) in nitrogen-hydrogen atmospheres containing 3 and 10% hydrogen. The iron-graphite powder was prepared by mixing ANCORSTEEL 1000 iron powder supplied by Hoeganaes Corporation of Riverton, N.J. with 0.9% fine graphite powder that was supplied by Southwestern Graphite Company of Burnet, Tex. The iron powder had an apparent density of 2.98 g/cc, and consisted of randomly shaped particles. Approximately 78% by weight of the particles present in the iron powder are retained by a 325 U.S. mesh sieve. In addition, approximately 10% by weight of the particles present in the iron powder are retained by a 100 U.S. mesh sieve. The iron powder contained 0.13% oxygen, 0.18% manganese, 0.12% copper, 0.05% nickel, and 0.07% chromium as major impurities. The graphite powder contained 96.2% carbon. The fine copper powder that was used to mix with iron-graphite powder was supplied by Alcan Powders & Pigments, a Division of Alcan Aluminum Corporation. It is marketed under the name 8081 Copper, and contained 99.87% copper. The copper powder had a particle size distribution wherein 63.7% by weight of particles pass through a 325 U.S. mesh sieve, 29.2% by weight of particles are retained by a 325 U.S. mesh sieve but pass through a 200 U.S. mesh sieve, and 7. 1% by weight of particles are retained by a 200 U.S. mesh sieve but pass through a 150 U.S. mesh sieve.

The iron-graphite and iron-graphite-copper powders were mixed with 0.75% zinc stearate powder as a lubricant which was supplied by Mallinckrodt Chemical, Inc. of St. Louis, Mo. The lubricant contained particles that were close to 17 microns in diameter. The iron-graphite and iron-graphite-copper powders together with zinc stearate were mixed well prior to their use. The resulting power and lubricant mixtures were then used to press 0.25"×0.50"×1.25" transverse rupture bars with close to 6.6 g/cc green density. These bars were then sintered at 2,050° F. (1121° C.) in nitrogen-hydrogen atmospheres containing 3 or 10% hydrogen.

The data from various Examples prepared to demonstrate the invention are summarized as follows:

EXAMPLE 1

A number of transverse rupture strength test bars pressed from the iron-graphite powder (with and without copper additions) described above were sintered in a continuous furnace operated at 2,050 °F. temperature in the presence of nitrogen-hydrogen atmosphere containing 3% or 10% hydrogen. The sintered bars without the addition of copper revealed a 0.25% growth in dimension irrespective of the amount of hydrogen present in the atmosphere, as shown in Table 1.

TABLE 1

| Example | Amount of Copper Added, % (By Weight) | Dimensional Change, % 3% Hydrogen Atmosphere | Dimensional Change, % 10% Hydrogen Atmosphere |
|---|---|---|---|
| 1 | 0.0 | 0.25 | 0.25 |
| 2 | 0.1 | 0.22 | 0.22 |
| 3 | 0.2 | 0.22 | 0.22 |
| 4 | 0.3 | 0.22 | 0.22 |
| 5 | 0.5 | 0.24 | 0.25 |
| 6 | 1.0 | 0.29 | 0.29 |

The transverse rupture strength of the sintered bars is summarized in Table 2. As shown in the table the sample without a copper addition had a transverse rupture strength close to 70,000 PSI irrespective of the amount of hydrogen used in the sintering atmosphere.

TABLE 2

| Example | Amount of Copper Added, % (By Weight) | Transverse Rupture Strength, KSI 3% Hydrogen (Atmosphere) | Transverse Rupture Strength, KSI 10% Hydrogen (Atmosphere) |
|---|---|---|---|
| 1 | 0.0 | 69.8 | 70.8 |
| 2 | 0.1 | 76.0 | 75.3 |
| 3 | 0.2 | 76.4 | 75.9 |
| 4 | 0.3 | 78.5 | 79.1 |
| 5 | 0.5 | 83.1 | 82.2 |
| 6 | 1.0 | 93.7 | 89.9 |

Both the dimensional change and transverse rupture strength values are well within the range specified by the powder supplier. The size change of the samples containing less than 1% by weight copper showed equal to or lower size change and higher transverse rupture strength.

The apparent surface hardness values of the sintered bars are summarized in Table 3. As shown in Table 3 the sample without a copper addition showed a variation in hardness from 45 to 55 HRB and from 43 to 54 HRB for bars sintered in 3% and 10% hydrogen, respectively.

TABLE 3

| Example | Amount of Copper Added, % (By Weight) | Variation in Apparent Surface Hardness, HRB 3% Hydrogen (Atmosphere) | Variation in Apparent Surface Hardness, HRB 10% Hydrogen (Atmosphere) |
|---|---|---|---|
| 1 | 0.0 | 45–55 | 43–54 |
| 2 | 0.1 | 50–58 | 50–57 |
| 3 | 0.2 | 51–59 | 50–57 |
| 4 | 0.3 | 54–61 | 53–60 |
| 5 | 0.5 | 56–62 | 54–61 |
| 6 | 1.0 | 62–69 | 62–69 |

A part of this large variation in apparent surface hardness value for bars made without a copper addition is due to the presence of porosity in the structure, and the remaining part is due to partial surface decarburization.

The microstructural analysis of the bars revealed partial surface decarburization of some of the sintered bars. The results are summarized in Table 4 where it is shown that the partial surface decarburization for bars produced without a copper addition and sintered under and atmosphere with 3% and 10% hydrogen was 2 mils (0.002 in.) and 5 mils (0.005 in.), respectively.

TABLE 4

| Example | Amount of Copper Added, % (By Weight) | Decarburization Depth, Mils 3% Hydrogen | 10% Hydrogen |
|---|---|---|---|
| 1 | 0.0 | 2.0 | 5.0 |
| 2 | 0.1 | 1.0 | 3.5 |
| 3 | 0.2 | None | None |
| 4 | 0.3 | None | None |
| 5 | 0.5 | None | None |
| 6 | 1.0 | None | None |

Note: 1 Mil = 0.001 in.

The above data clearly show that the use of hydrogen in the sintering atmosphere results in partial surface decarburization of conventional (no copper addition) sintered carbon steel components. It also shows that the extent of decarburization increases with the increase in hydrogen concentration in the nitrogen-hydrogen atmosphere. Furthermore, the above data shows the partial surface decarburization of sintered carbon steel components resulted in decreasing the apparent surface hardness and increasing the variation in apparent surface hardness with the amount of hydrogen in the atmosphere. Both the decrease in the apparent surface hardness and increase in variation in the apparent surface hardness will decrease the wear resistance properties of the sintered components, and therefore, are not desirable.

EXAMPLE 2

A number of transverse rupture strength test bars pressed from the iron-graphite powder mixed with 0.1% fine copper powder were sintered in a continuous furnace at 2,050° F. temperature in the presence of nitrogen-hydrogen atmosphere containing 3% and 10% hydrogen. The sintered bars revealed a 0.22% growth in dimension irrespective of the amount of hydrogen used. This growth is well within the specified range for iron-graphite powders (see Table 1). The transverse rupture strength of the sintered bars summarized in Table 2 was close to 76,000 PSI irrespective of the amount of hydrogen present in the atmosphere.

The mixing of 0. 1% copper into the iron-graphite powder increased the strength by ~8.5%, which is desirable and well within the range specified for carbon steel components. The apparent surface hardness values of the sintered bars summarized in Table 3 showed a variation from 50 to 58 HRB and from 50 to 57 HRB for bars sintered in 3% and 10% hydrogen, respectively. The apparent surface hardness values were slightly higher than those noted without the inclusion of 0.1% copper. The microstructural analysis of the bars revealed considerably reduced partial surface decarburization on the sintered bars—the depth of decarburization noted with 3% and 10% hydrogen in the atmosphere as set out in Table 4 was 1 mils (0.001 in.) and 3.5 mils (0.0035 in.), respectively.

The above information clearly shows that the use of hydrogen in the sintering atmosphere results in partial surface decarburization of sintered carbon steel components even with the addition of 0.1% copper. It also showed that the extent of decarburization increases with the increase in hydrogen concentration in the nitrogen-hydrogen atmosphere. However, the strength of sintered components increased and the extent of partial surface decarburization decreased considerably with the addition of 0.1% copper. Additionally, the apparent surface hardness values increased and the variation in the apparent surface hardness decreased with the use of 0.1% copper. The reduction in the variation in apparent surface hardness value is directly related to reduced surface decarburization noted with the addition of 0.1% copper to iron-graphite powder. These improvements in properties are unexpected, and will lead to, improved wear performance of the sintered carbon steel components.

EXAMPLES 3–5

The sintering experiment described in Example 2 was repeated three times using the same sintering temperature and hydrogen concentrations with the exception of changing the composition by mixing 0.2, 0.3, and 0.5% copper into the iron-graphite powder used to form the bars. The bars sintered in these experiments revealed a dimensional growth ranging from 0.22 to 0.25% which was well within the specified range for iron-graphite powders (see Table 1). The transverse rupture strength of bars sintered in these examples ranged from 76,000 to 83,000 PSI, as summarized in Table 2. The use of 0.2 to 0.5% copper increased the strength of sintered bars by ~8.5 to 18.5%. The apparent surface hardness values of the sintered bars as summarized in Table 3 were higher than those noted in Example 1. Furthermore, the variation in apparent surface hardness was lower than noted in Example 1. More importantly, however, the use of 0.2% or more of copper eliminated the surface decarburization of sintered bars even in the presence of 10% hydrogen.

The above information clearly showed that the use of 0.2% or more of copper to iron-graphite powder is extremely beneficial in terms of eliminating surface decarburization even in the presence of excessive amounts of hydrogen, improving strength and apparent surface hardness, and reducing the variation in apparent surface hardness. These improvements in properties are unexpected, and are responsible for producing carbon steel components with consistent quality and properties. More importantly, the addition of 0.5% copper into the iron-graphite powder increases the powder cost by only 1 cent per pound which should be totally acceptable to carbon steel powder metal parts producers.

EXAMPLE 6

The sintering experiment described in Example 2 was repeated using the same sintering temperature and hydrogen concentrations with the exception of mixing 1.0% copper into the iron-graphite powder. The bars sintered in these experiments revealed 0.29% dimensional growth which was slightly higher than noted with iron-graphite powders (see Table 1). The transverse rupture strength of sintered bars was close to 90,000 PSI, which was also higher than the value typically called for carbon steel components (see Table 2). The apparent surface hardness values of the sintered bars summarized in Table 3 were considerably higher than those noted in Example 1, and were more than normally called for carbon steel components. The use of 1.0% copper, as expected, eliminated the surface decarburization of sintered bars even in the presence of 10% hydrogen.

The above information clearly shows that the use of 1.0% copper in iron-graphite powder far exceeds the physical and mechanical properties normally called for in carbon steel powder metal components. More importantly, mixing of 1.0% copper into the iron-graphite powder increases the powder cost by 2 cents per pound of powder, a cost that might not be acceptable to carbon steel powder metal parts producers.

Comparing the data presented in Tables 1 through 4 shows that incorporation of small amounts of fine copper powder into an iron-graphite powder composition does not significantly alter the properties of the parts produced from identical powders without incorporation of the fine copper powder. However, the incorporation of fine copper powder minimizes the variations in the physical properties of the pressed and sintered parts when the amount of hydrogen in the sintering furnace atmosphere varies.

Having thus described our invention what is desired to be secured by Letters Patent of the United States is set forth in the appended claims.

1. A method for minimizing the adverse effects of variations in hydrogen content in hydrogen-nitrogen atmospheres used to sinter iron-graphite powder compacts comprising the steps of:

preparing a powder mixture consisting essentially of, by weight, 0.2 to 1.2% graphite powder, 0.1 to 0.9% copper powder, 0.0 to 2.0% lubricant, balance iron powder, said copper and iron powders having particle sizes selected so that at least 75% by weight of the iron powder is retained by a 325 U.S. mesh sieve and at least 60% by weight of copper powder will pass through a 325 U.S. mesh sieve;

pressing said powder mixture to shape where said pressed shape has a green density of between 6.4 and 7.4 g/cc; and sintering said pressed shape in a furnace maintained at a temperature of at least about 2000° F. under an atmosphere containing a maximum of 15% hydrogen for a period of time to achieve the desired physical properties.

2. A method according to claim 1 wherein preparation of said powder mixture is accomplished by mixing 0.5 to 1.2% by weight graphite powder, 0.1 to 0.75% by weight copper powder 0.0 to 1.5% by weight lubricant, balance iron powder, and pressing said powder mixture to a shape having a green density of between 6.6 and 7.2 g/cc.

3. A method according to claim 1 wherein preparation of said powder mixture is accomplished by mixing 0.3 to 1.2% by weight graphite powder, 0.2 to 0.6% by weight copper powder, 0.0 to 1.2 by weight lubricant, balance iron powder, and pressing said powder mixture to a green density of from 6.8 to 7.2 g/cc.

4. A method according to claim 1 wherein said lubricant is selected from the group consisting of zinc stearate, lithium stearate and N,N' Ethylenebisstearamide.

5. A method according to claim 1 wherein said atmosphere consists of 0.0 to 0.5% by volume enriching gas selected from the group consisting of methane, natural gas, petroleum gas and propane, 1.0 to 15.0% by volume hydrogen, balance nitrogen.

6. A method according to claim 1 wherein at least 85% by weight of the iron powder is retained by a 325 U.S. mesh sieve.

7. A method according to claim 1 wherein at least 70% by weight of the copper powder passes through a 325 U.S. mesh sieve.

8. A method according to claim 6 wherein at least 70% by weight of the copper powder passes through a 325 U.S. mesh sieve.

9. A powder mixture suitable for pressing and sintering into predetermined shapes showing resistance to variations in physical properties between pieces produced in a given batch or run, said powder consisting essentially of, by weight, 0.2 to 1.2% graphite powder, 0.1 to 9% copper powder, 0.0 to 2% lubricant, balance iron powder said copper and iron powders having particle sizes wherein at least 75% by weight of the iron powder is retained by a 325 U.S. mesh sieve and at least 60% by weight of the copper powder passes through a 325 U.S. mesh sieve.

10. A powder according to claim 9 containing, by weight 0.5 to 1.2% graphite powder, 0.1 to 0.75% copper powder, 0.0 to 1.5% lubricant, balance iron powder.

11. A powder according to claim 9 containing, by weight, 0.8 to 1.2% graphite powder, 0.2 to 0.6% copper powder, 0.0 to 1.0% lubricant, balance iron powder.

12. A powder according to claim 9 wherein at least 85% by weight of the iron powder is retained by a 325 U.S. mesh sieve.

13. A powder according to claim 9 wherein at least 70% by weight of the copper powder passes through a 325 U.S. mesh sieve.

14. A powder according to claim 12 wherein at least 70% by weight of the copper powder passes through a 325 mesh U.S. sieve.

15. A powdered metal part produced by:

preparing a powder mixture consisting essentially of, by weight, 0.2 to 1.2% graphite powder, 0.1 to 0.9% copper powder, 0.0 to 2.0% lubricant, balance iron powder, said copper and iron powders having particle sizes such that at least 75% by weight of the iron powder is retained by a 325 U.S. mesh sieve and at least 60% by weight of the copper powder will pass through a 325 U.S. mesh sieve;

pressing said powder mixture to shape where said pressed shape has a green density of between 6.4 and 7.4 g/cc; and sintering said pressed shape in a furnace maintained at a temperature of at least about 2000° F. under an atmosphere containing a maximum of 15% hydrogen for a period of time to achieve the desired physical properties.

16. A part according to claim 15 wherein preparation of said powder mixture is accomplished by mixing 0.5 to 1.2% by weight graphite powder, 0.1 to 0.75% by weight copper powder 0.0 to 1.5% by weight lubricant, balance iron powder, and pressing said powder mixture to a shape having a green density of between 6.6 and 7.2 g/cc.

17. A part according to claim 15 wherein preparation of said powder mixture is accomplished by mixing 0.3 to 1.2% by weight graphite powder, 0.2 to 0.6% by weight copper, 0.0 to 1.2 by weight lubricant, balance iron powder, and pressing said powder mixture to a green density of from 6.8 to 7.2 g/cc.

18. A part according to claim 15 wherein said lubricant is selected from the group consisting of zinc stearate, lithium stearate and Acrawax.

19. A part according to claim 15 wherein said atmosphere consists of 0.0 to 0.5% by volume enriching gas selected from the group consisting of methane, natural gas, petroleum gas and propane, 1.0 to 15.0% by volume hydrogen, balance nitrogen.

20. A part according to claim 15 wherein at least 85% by weight of the iron powder is retained by a 325 U.S. mesh sieve.

21. A part according to claim 15 wherein at least 70% by weight of the copper powder passes through a 325 U.S. mesh sieve.

22. A part according to claim 20 wherein at least 70% by weight of the copper powder passes through a 325 U.S. mesh sieve.

* * * * *